US010822155B2

(12) United States Patent
Khomenko et al.

(10) Patent No.: US 10,822,155 B2
(45) Date of Patent: Nov. 3, 2020

(54) DRINKING VESSEL SYSTEM

(71) Applicants: Anton Khomenko, Chino Hills, CA (US); Febian Bahari, Eastvale, CA (US); Oleksii Karpenko, Lansing, MI (US)

(72) Inventors: Anton Khomenko, Chino Hills, CA (US); Febian Bahari, Eastvale, CA (US); Oleksii Karpenko, Lansing, MI (US)

( * ) Notice: Subject to any disclaimer, the term of this patent is extended or adjusted under 35 U.S.C. 154(b) by 97 days.

(21) Appl. No.: 16/052,848

(22) Filed: Aug. 2, 2018

(65) Prior Publication Data

US 2019/0039812 A1 Feb. 7, 2019

Related U.S. Application Data

(60) Provisional application No. 62/540,566, filed on Aug. 3, 2017.

(51) Int. Cl.

| | |
|---|---|
| ***B65D 81/38*** | (2006.01) |
| ***A47G 19/22*** | (2006.01) |
| ***A47G 23/02*** | (2006.01) |

(52) U.S. Cl.

CPC ..... *B65D 81/3874* (2013.01); *A47G 19/2288* (2013.01); *A47G 23/0216* (2013.01)

(58) Field of Classification Search

CPC ..... B65D 81/00–3874; B65D 35/56; B65D 71/14; B65D 59/04; B65D 5/6617; B65D 5/6688; B65D 1/265; B65D 7/24; B65D 5/36; B65D 5/3621; A47G 23/00–0216; A47G 19/00–2288

USPC ..... 220/666, 62.12, 62.13, 62.14, 62.15, 220/62.16, 62.17, 62.18, 62.19, 23.86, 220/23.87

See application file for complete search history.

(56) References Cited

U.S. PATENT DOCUMENTS

| | | | | |
|---|---|---|---|---|
| 4,802,602 | A | 2/1989 | Evans et al. | |
| 4,871,597 | A | 10/1989 | Hobson | |
| 5,205,473 | A | 4/1993 | Coffin, Sr. | |
| D354,420 | S * | 1/1995 | Sharp | D7/607 |
| 5,385,260 | A * | 1/1995 | Gatcomb | B65D 3/06 229/400 |
| 5,826,786 | A | 10/1998 | Dickert | |
| 5,857,615 | A | 1/1999 | Rose | |

(Continued)

*Primary Examiner* — Kareen K Thomas
(74) *Attorney, Agent, or Firm* — Loomis, Ewert, Parsley, Davis & Gotting P.C.; Mikhail Murshak

(57) ABSTRACT

A reusable and disposable drinking container and vessel system includes a holder having a body formed between opposed connectable ends. The connectable ends form a rigid structure when the connectable ends are engaged. The rigid structure includes a sidewall, a rim, and defines an opening. An insert, defining a flexible body sized and shaped to fit within the opening of the holder, is provided to engage the rigid structure of the holder. The flexible body includes a bottom and a sidewall forming a drinking cavity extending from the bottom to the opening. The holder and the reusable insert are disengagable. The holder is compactable when the connectable ends are disengaged. The system provides enhanced insulation, better hygiene, and superior thermo-mechanical properties and chemical resistance. The system provides an opportunity to substitute disposable paper and plastic cups, which are difficult to recycle.

17 Claims, 15 Drawing Sheets

(56) References Cited

U.S. PATENT DOCUMENTS

| | | | | |
|---|---|---|---|---|
| 7,699,216 | B2 | 4/2010 | Smith et al. | |
| 7,922,031 | B1 | 4/2011 | Prince | |
| 8,960,528 | B2 * | 2/2015 | Sadlier | B65D 3/22 229/403 |
| 9,539,783 | B2 | 1/2017 | Wischusen, III | |
| 9,585,501 | B1 * | 3/2017 | Hamelink | A47G 19/2288 |
| 9,586,745 | B1 | 3/2017 | Givler | |
| 9,708,098 | B2 | 7/2017 | Plott et al. | |
| 9,795,233 | B2 | 10/2017 | Brown et al. | |
| 9,877,605 | B2 | 1/2018 | Clark | |
| 2011/0192859 | A1 * | 8/2011 | Belford | A61J 9/06 220/739 |
| 2011/0248037 | A1 * | 10/2011 | Fung | B65D 81/3869 220/592.2 |
| 2012/0234846 | A1 * | 9/2012 | Costanzo, Jr. | B65D 5/4266 220/738 |
| 2013/0032592 | A1 * | 2/2013 | Lee | B65D 21/086 220/8 |
| 2015/0253055 | A1 * | 9/2015 | Tsui | B65D 21/086 62/62 |

* cited by examiner

DRINKING VESSEL SYSTEM

CROSS REFERENCE TO RELATED APPLICATION

Priority is claimed to U.S. Provisional Application No. 62/540,566 filed Aug. 3, 2017 which is incorporated herein by reference in its entirety.

TECHNICAL FIELD

The present disclosure relates generally to beverage containers and vessels, in particular a system of eco-friendly removable and reusable inserts operable to be placed inside a reusable or disposable holder.

BACKGROUND

Various techniques and devices which provide enhanced insulation of a container or vessel in order to keep its contents at desired temperatures and to reduce hot/cold transfer, particularly to a user's hand, are known. While such enhancements provide advantages, they have several limitations and drawbacks. For example, U.S. Pat. No. 5,205,473 to Coffin and U.S. Pat. No. 7,699,216 to Smith et al. disclose disposable double-walled containers providing enhanced insulation. However, these containers were not widely adopted because of the complexity and the cost of manufacturing. U.S. Pat. No. 5,826,786 to Dickert and U.S. Pat. No. 7,922,031 to Prince disclose using a combination of single-walled disposable containers with a sleeve.

Another pressing issue is that a great number of disposable containers are not recycled, but wasted, which negatively impacts the environment. Although the problem persists for many years, a need remains for a more effective solution.

Thus, a need exists for a device and system to overcome certain of these limitations and other drawbacks of the prior art.

SUMMARY

The present disclosure describes a drinking vessel system having an insert engagement with a holder. In an example, a system is provided that includes a removable and reusable insert and matching compact and lightweight holder compatible with the insert.

The present disclosure provides for a drinking vessel system including a holder having a body formed between opposed connectable ends. The connectable ends form a rigid structure when the connectable ends are engaged. The rigid structure includes a sidewall, a rim, and defines an opening. An insert is provided that includes a flexible body sized and shaped to fit within the opening of the holder and engage the rigid structure of the holder. The flexible body includes a bottom and a sidewall forming a drinking cavity extending from the bottom to the opening. The holder and the reusable insert are disengagable. The holder is compactable when the connectable ends are disengaged.

In a further example, the holder can be made from reusable or disposable material, e.g., compostable or water-soluble. The insert is operable to be used inside an enclosed, open-ended, and/or hollow holder with regular or irregular shape, e.g., mug, cup, bottle, sleeve, frame, case, shell, jacket, etc. Thus, a holder serves as a host while the insert becomes an inner layer providing superior thermomechanical, e.g., insulation, and chemical protection. The use of the insert can help reduce or prevent contamination of the holder with the contents or by the user. After each use, the insert can be easily cleaned, e.g., rinsed if the insert is made from hydrophobic material. Although the insert is compatible with many existing holders such as disposable cups or sleeves from corrugated cardboard, a suitable holder design is disclosed, which provides improved performance.

In an example, a holder according to the present disclosure defines a shape of a hollow structure, which can be made compact by rolling, folding using a single or multiple folds, e.g., accordion fold, etc. Additionally, this structure can have fasteners including but not limited to: belts, buttons, stud joints, lap joints, etc. to facilitate proper fit of the holder on the insert or any other container or vessel.

In another example, an insert of the present disclosure can be comprised of a single or multiple layers made from sole material, mixture of different materials, or composite material. The insert may have internal structural reinforcements made from other materials including but not limited to: thin washers, discs, rings, stiffeners, struts, conical cylinders, plates, etc. The insert may have internal or external devices including but not limited to: zip lock, channel and matching insert, stud joint, buttons, adhesive, etc. to facilitate the ease of sealing the insert. The insert material can have inclusions and reinforcements with various sizes, e.g., from few nm to tens of cm, randomly or strategically distributed inside. Inclusions can define arbitrary or predetermined shapes, e.g., air, pigments, nanoparticles such as nanoclay, microparticles such as silica microbubbles, polymers, low vacuum voids, ions, chopped and continuous fibers, etc.

The present disclosure provides for an insert provided in various forms and designs, with differences including but not limited to: transparency, color, scent, ornaments and decorations, etc. In an example, the insert can be used as an auxiliary device along with reusable and disposable holders. The removable and reusable insert has additional benefits, such as enhanced insulation, improved chemical resistance, better hygiene, opportunity to reuse or substitute disposable holders such as paper cups, plastic cups, etc.

Example benefits of the removable and reusable insert of the present disclosure include but are not limited to:

- Excellent heat resistance, cold flexibility, dielectric properties, and especially good resistance to weather, ozone and UV rays if made from suitable material, e.g., silicone rubber.
- Good chemical resistance if made from suitable material, e.g., silicone rubber.
- Mechanical protection of holder interior, e.g., from abrasive contents. For example, silicone rubber does not fade or scratch.
- Enhanced insulation keeps the contents of a holder, e.g., container, at desired temperatures for longer times. Since the hot/cold transfer to a user's hand is reduced, there is no need for an additional jacket/sleeve.
- Lightweight, compact and highly portable if the insert is made of lightweight and flexible material, e.g., silicone rubber.
- Flexible, durable and shatter resistant if the insert is made of suitable material, e.g., silicone rubber.
- Reusability of disposable holders. The insert prevents contamination of disposable holders, e.g., paper or plastic cups, providing the opportunity to reuse those again.
- Substitution or disposable holders, e.g., paper or plastic cups, if used along with the described holder.
- More hygienic goods consumption since there is no direct contact of user with a holder, e.g., container. For example, silicone rubber is hygienic and hypoallergenic with no open pores to harbor bacteria. Furthermore, the insert can be made of material with anti-bacterial and anti-mold properties.

Dishwasher and microwave safe if the insert is made of temperature-resistant FDA-approved material, e.g., silicone rubber.

Ease of cleaning if the insert is made from hydrophobic material, e.g., silicone rubber, which is odor and stain resistant.

Recyclability if the insert is made of recyclable material, e.g., silicone rubber is 100% recyclable.

BRIEF DESCRIPTION OF THE DRAWINGS

The other aspects of the present disclosure will become better understood by reference to the following description when considered in connection with the accompanying drawings wherein.

DETAILED DESCRIPTION

The present disclosure provides for a drinking vessel or container system to facilitate improved and alternatives to disposable cups/glasses. The present disclosure provides for a drinking vessel system including a removable and reusable or disposable insert which is used in combination with an enclosed, open-ended, or hollow, reusable or disposable holder. In an example, the holder defines a shape, e.g., mug, cup, bottle, sleeve, frame, case, shell, jacket, etc.

Figure 1:
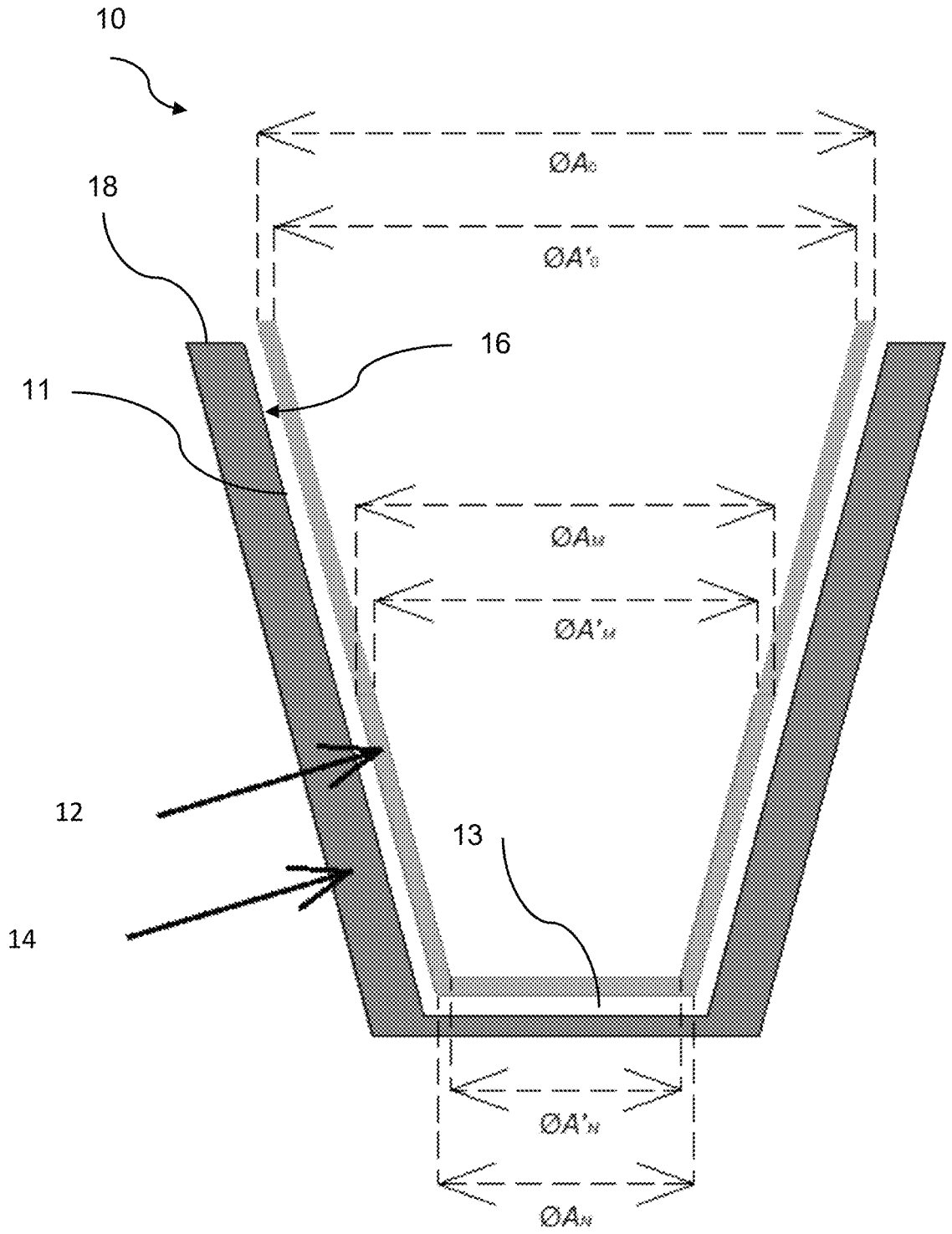
FIG. 1 is an example cross-section schematic of the removable and reusable insert placed inside a holder according to the present disclosure.

Referring to FIG. 1, system 10 includes a flexible insert 12 and a holder 14. In this example, the insert 12 traces an inner surface 16 of the holder 14, and the inner surface 16 defines a sidewall 11 and a bottom 13 forming a cavity. Not all holders include a bottom. The holder 14 of FIG. 1 defines a gradual change of insert diameter from $A_N$ (holder bottom) through $A_M$ (holder middle) to $A_0$ (top of the holder). This substantially defines a conical geometry and effective for a drinking container. Holder 14 defines a rigid structure having a rim 18 and together with the sidewall serves as a host while the insert 12 engages with the holder 14 and becomes an inner layer of system 10. In this example, the insert 12 is fabricated from a material of improved thermal heat capacity as compared to the holder alone. In one form, the insert 12 includes one or more insulating layers. In yet another form, the insert is fabricated from a flexible hydrophobic material, such as a silicon-based rubber material. The insert 12 can be flexible and fully sealed as to not allow leaking. Accordingly, the insert 12 can be suitable to provide improved thermomechanical, e.g., insulation, and chemical protection. The system 10 further allows for the use of the insert 12 being operable to improve and/or prevent contamination of the holder 14 by a beverage or the user. In an example, where the insert 12 is reusable, after each use the insert 12 can be easily cleaned, e.g., turned inside out and rinsed.

Figure 2:
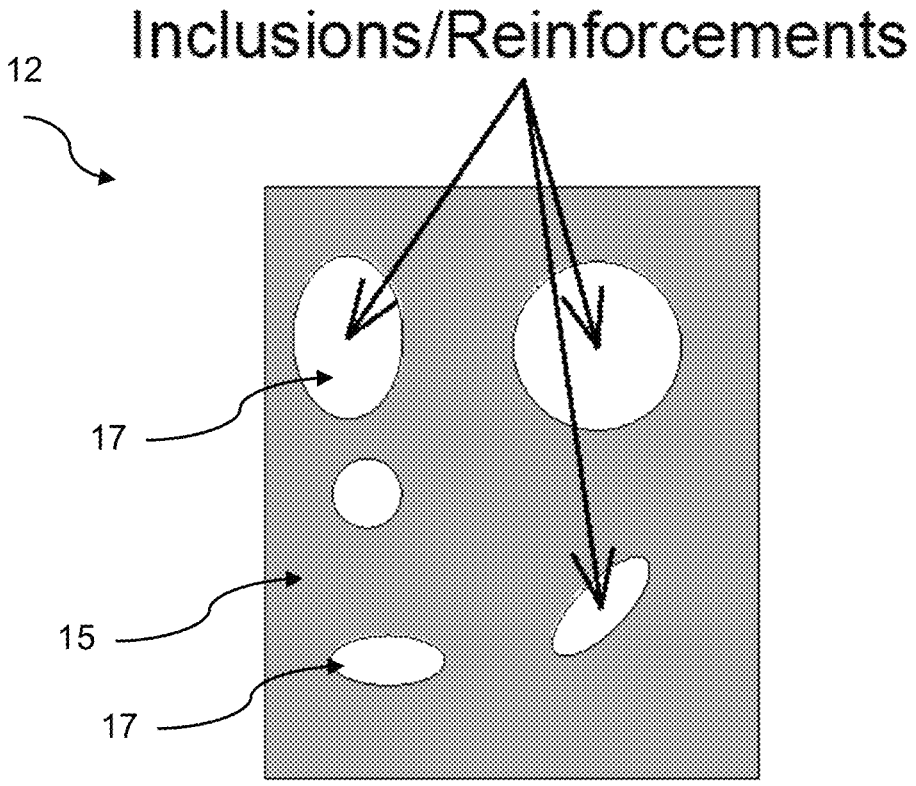
FIG. 2 illustrates example inclusions and reinforcements provided inside an example reusable and removable insert.

Referring to FIG. 2, a removable and reusable insert 12 is shown. In an example, insert 12 includes one or more insulating layers 15 made from a single material, mixture of different materials, or composite material. The insert 12 may have internal structural reinforcements 17 made from other materials including but not limited to: thin washers, discs, rings, stiffeners, struts, conical cylinders, plates, etc. The insert can be made of material 15 with enhanced physical and chemical properties, e.g., with enhanced insulation if made from silicone rubber, and of material enhanced by the inclusions and reinforcements 17, as illustrated in FIG. 2. These inclusions and reinforcements 17 may have various sizes, e.g., from few nm to tens of cm, randomly or strategically distributed inside material 15. Inclusions 17 may be with arbitrary or predetermined shape, e.g., air, pigments, nanoparticles such as nanoclay, microparticles such as silica microbubbles, polymers, low vacuum voids, ions, chopped and continuous fibers, etc. In yet another example, thermochromic pigment or particles providing anti-bacterial and anti-mold properties may be added to the insert material 15 in order to extend the functionality of the removable and reusable insert 12.

Figure 3:
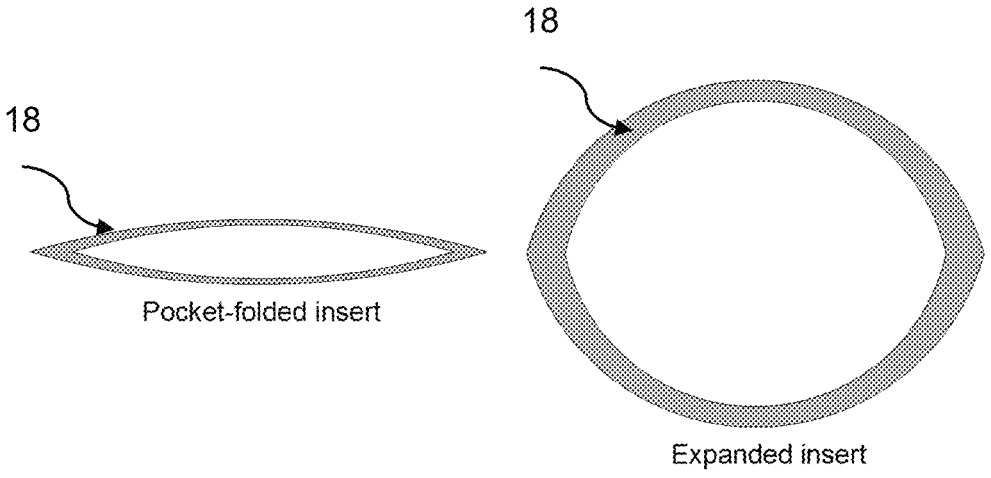
FIG. 3 is a top view illustration of a fold of the removable and reusable insert, in an example.

Referring to FIG. 3, for portability and compactness, the removable and reusable insert 12 can be folded, e.g., as a pocket. This can be achieved by making thinner insert's wall, pre-folded manufacturing, notches, a highly flexible material, etc. FIG. 3 illustrates a top view of the rim 18 of removable and reusable insert 12 in folded and expanded states, as an example.

Figure 4:
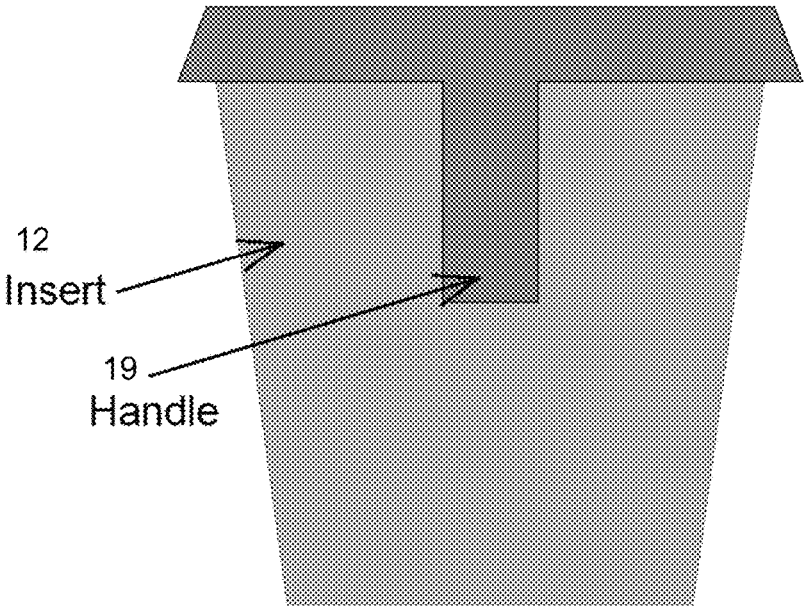
FIG. 4 is a side view illustration of an accessory for quick and easy extraction of the removable and reusable insert from a host holder, in an example.

Referring to FIG. 4, another example of system 10 is shown having a removal feature 19. Insert 12 and holder 14 engage in a removable relationship such that insert 12 can be removed from holder 14 as desired by a user. In yet another example, insert 12 can have extruded parts 19 and attached accessories to facilitate quick and easy extraction of the insert 12 from the holder 14 during use. Such accessories are including but not limited to: handles, threads, ribbons, braids, tapes, bands, strips, etc.

Figure 5:
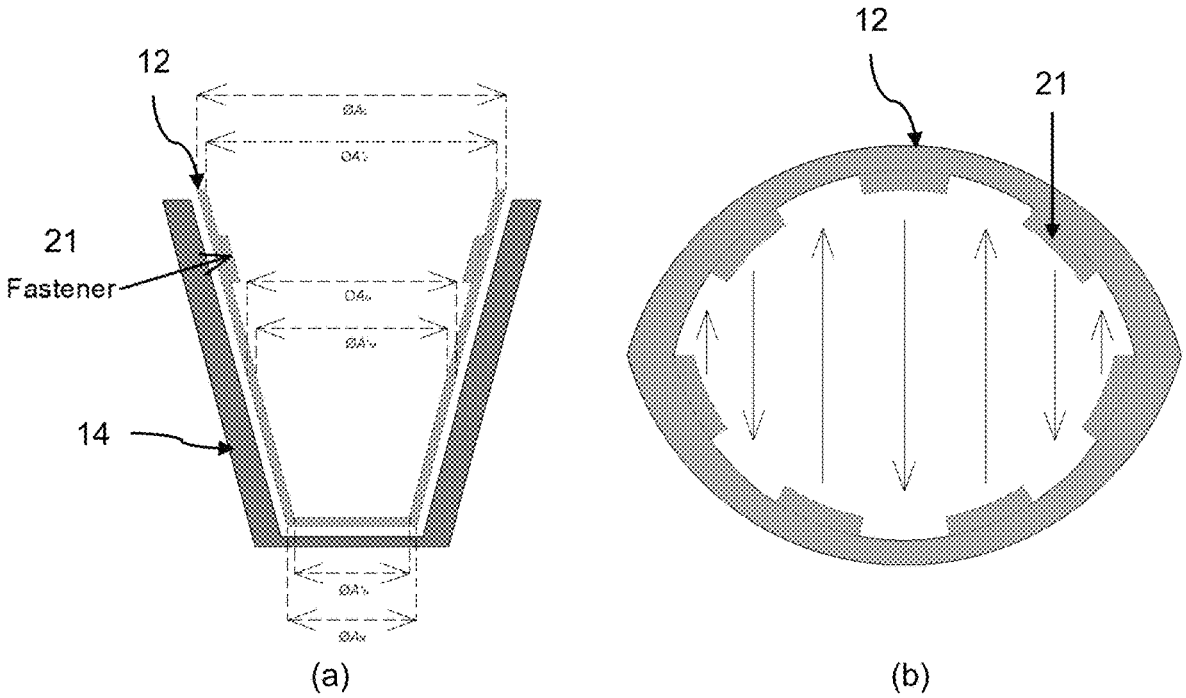
FIG. 5 is an illustration of side and top view of a matching lock pattern inside the removable and reusable insert, in an example.

Referring to FIGS. 5(*a*) and 5(*b*), in yet a further example, insert 12 includes internal or external devices 21 or fasteners 21 positioned at arbitrary angles, e.g., vertical or circumferential, which include but are not limited to: zip lock, channel and matching insert, stud joint, buttons, adhesive, etc. to facilitate the ease of sealing the insert in order to avoid the spill of residual food or beverage. As an example, a side view 5(*a*) and top view 5(*b*) of a matching lock pattern 21 is shown.

Figure 6:
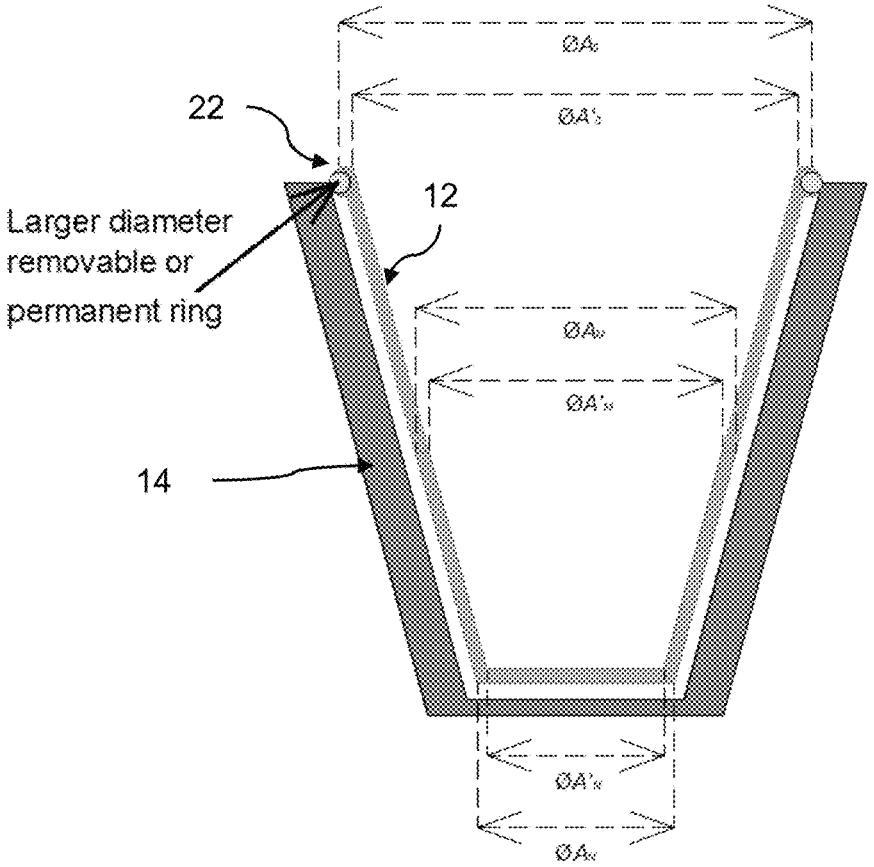
FIG. 6 is an example cross-section schematic of the removable and reusable insert with insert internal stopper fixture inside a holder.
Figure 7:
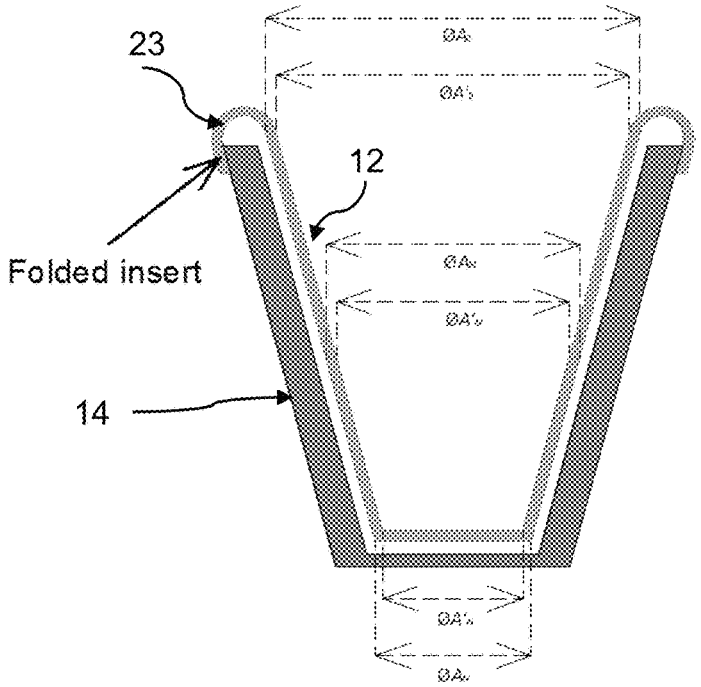
FIG. 7 is an example cross-section schematic of the removable and reusable insert with insert fold fixture around the rim of a holder.
Figure 8:
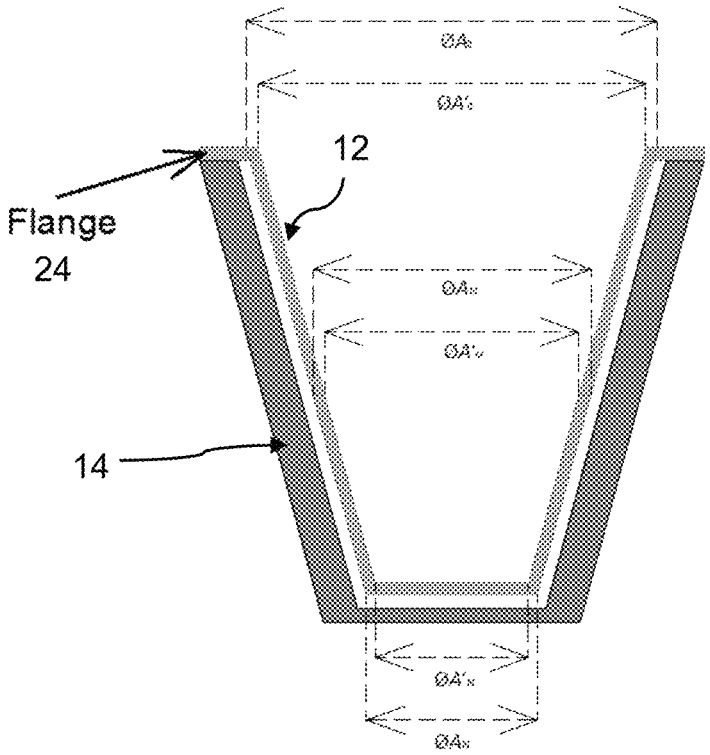
FIG. 8 is an example cross-section schematic of the removable and reusable insert with insert rim forming a flange fixture outside of a holder.
Figure 9:
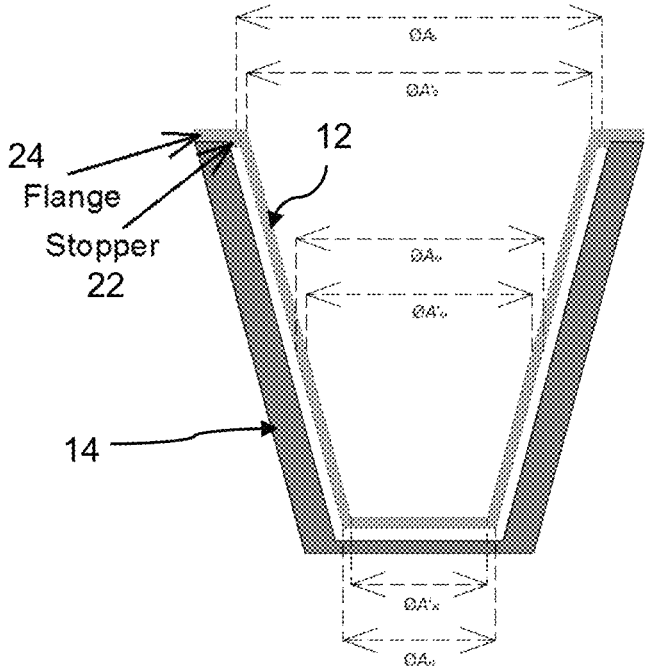
FIG. 9 is an example cross-section schematic of the removable and reusable insert with insert rim forming a flange fixture in combination with insert internal stopper fixture inside a holder.
Figure 10:
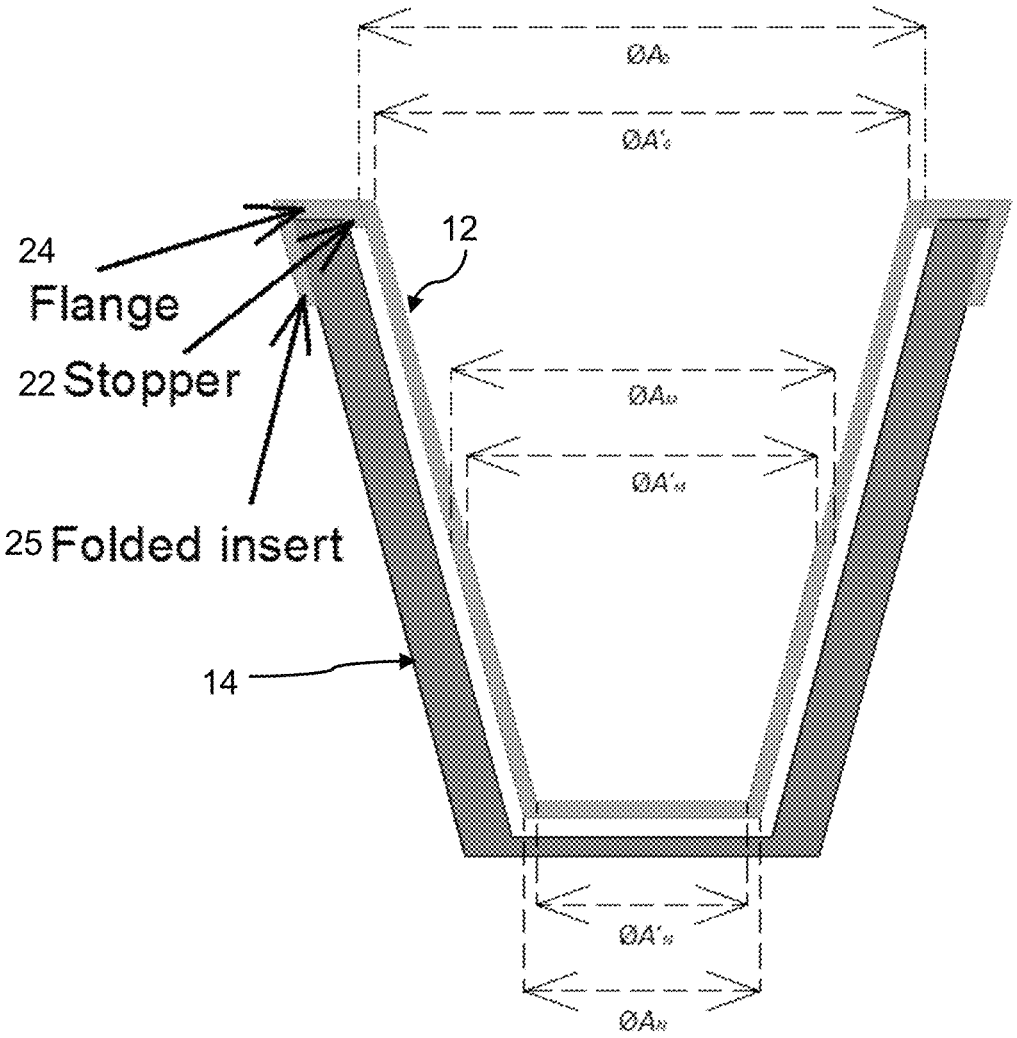
FIG. 10 is an example cross-section schematic of the removable and reusable insert with combination of insert rim forming a flange fixture and insert folded around the rim of a holder in conjunction with insert internal stopper fixture inside a holder.
Figure 11:
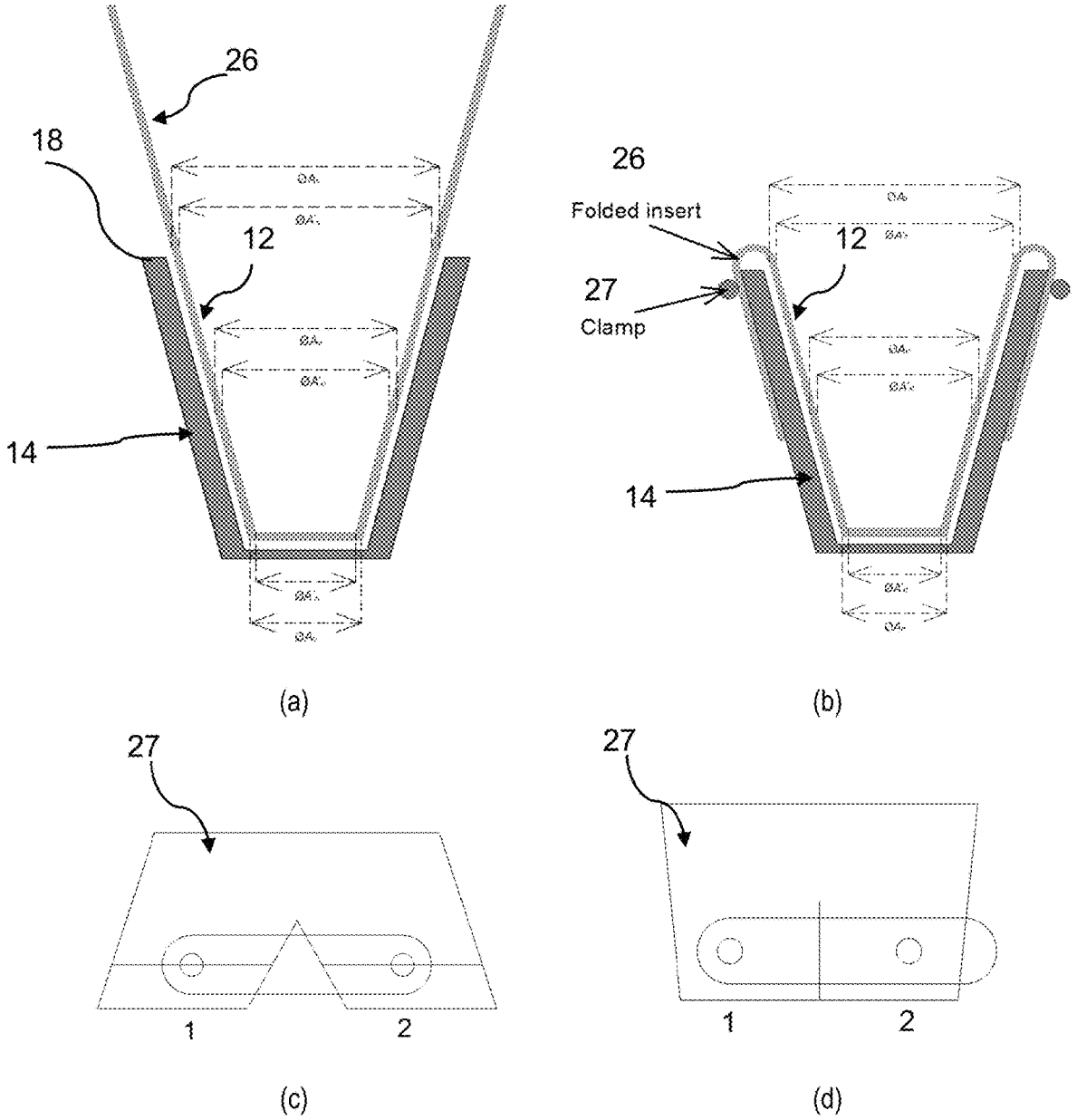
FIG. 11 is an example cross-section schematic of the removable and reusable insert with extended insert fold fixture around the rim of a holder: (a) unfolded insert inside a holder; (b) the insert is folded around the rim of a holder and secured with external fastener; (c) untightened fastener of the insert; (d) tightened fastener of the insert.
Figure 12:
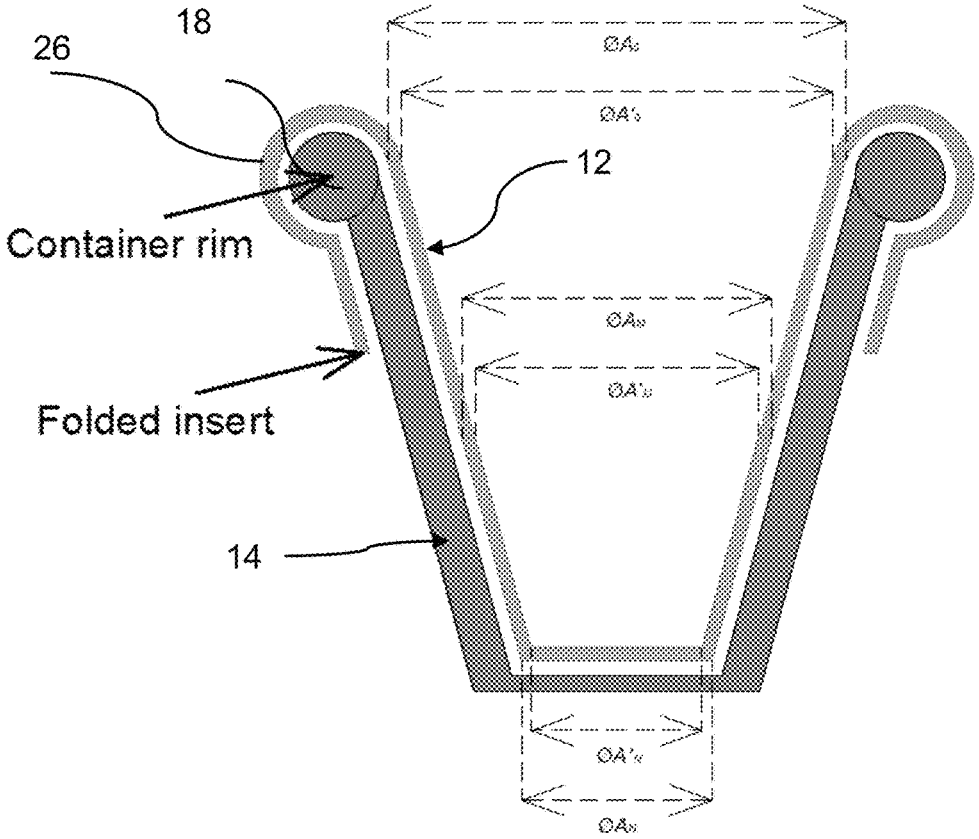
FIG. 12 is an example cross-section schematic of the removable and reusable insert with extended insert fold fixture forming a yoke around the rim of a holder.
Figure 13:
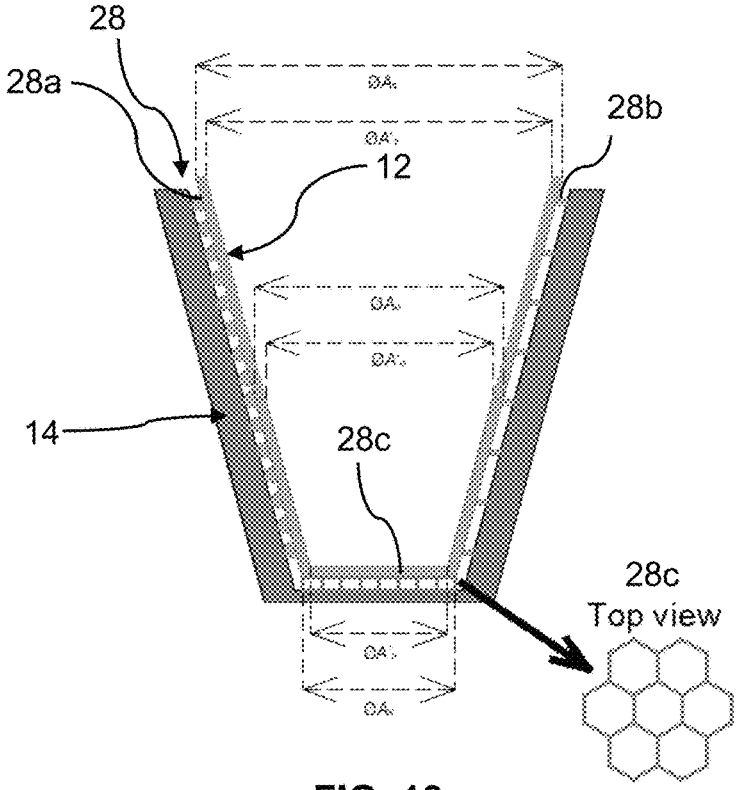
FIG. 13 is an example cross-section schematic of the removable and reusable insert with fixture using stiffeners and spacers.
Figure 14:
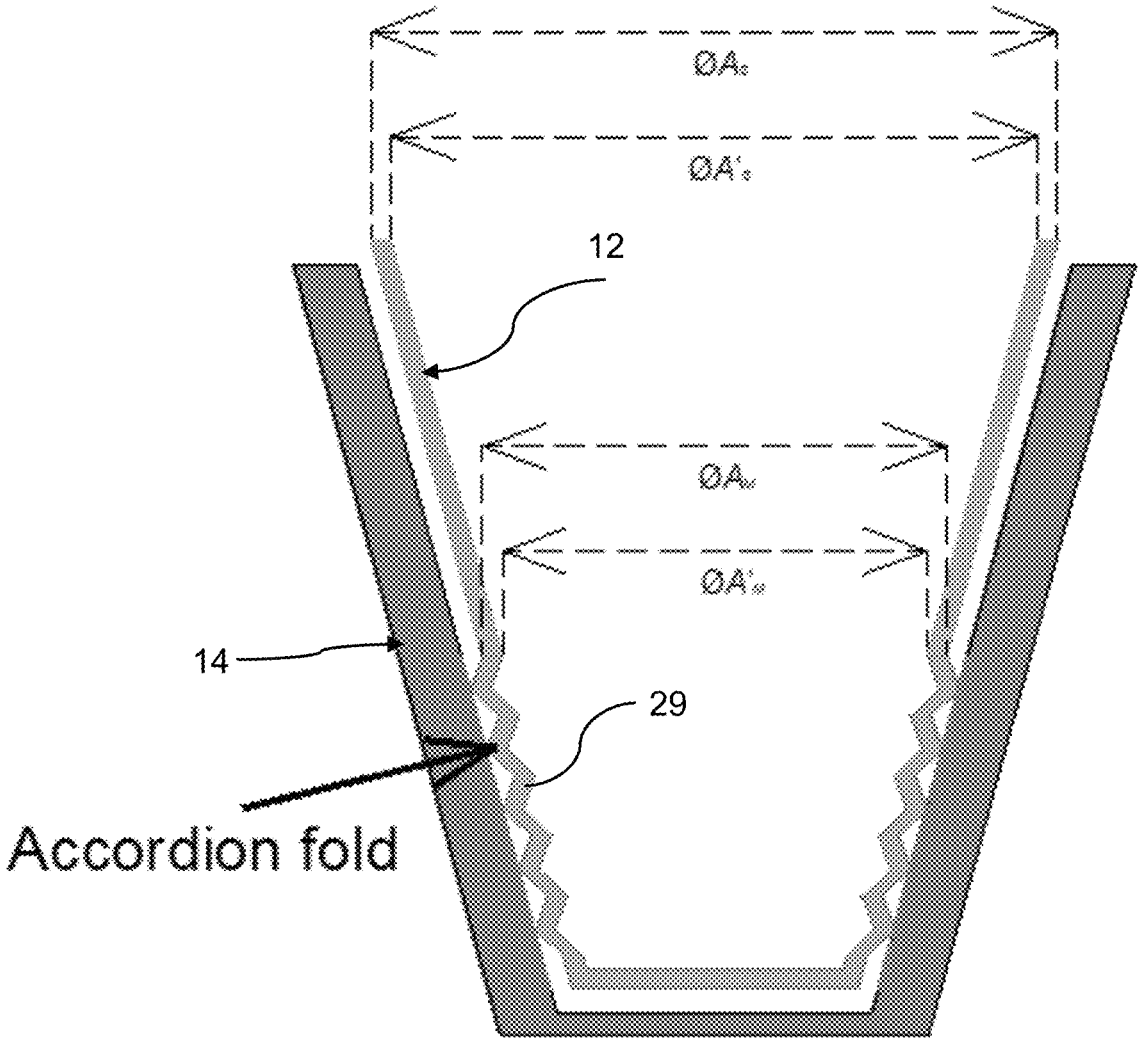
FIG. 14 is an example cross-section schematic of the removable and reusable insert with accordion fold fixture inside a holder.

Insert 12 may assume various forms and have numerous designs, with differences including but not limited to: transparency, color, scent, ornaments and decorations, etc. The gap between the insert 12 and the internal wall 11 of a holder 14 can vary from close contact to several mm. In one form, the insert 12 can be engaged or fixed inside a holder 14 using various devices including but are not limited to: suction cups, friction, adhesives, clamps, fasteners, etc. The insert can be fit inside a holder using various additional configurations, which include but are not limited to any or combination of the following examples:

- Insert 12 having an internal stopper 22, e.g., removable or permanent larger diameter outer ring, which is illustrated in FIG. 6.
- Insert 12 having an extension 23 folded around the rim of a holder 14 as shown in FIG. 7. The folded insert 12 is providing additional barrier between the user and an outer wall of the holder 14.
- Insert 12 having a rim forming a flange 24, which acts as a stopper as shown in FIG. 8.
- Insert 12 having a combination of flange 24 and internal stopper 22 fixtures, as shown in FIG. 9.
- Insert 12 having a combination of flange 24, internal stopper 22 with additional insert fold 25 around holder rim as shown in FIG. 10.
- Insert 12 having a fixture with an extended insert fold 26 around rim 18 the holder 14 partially or completely covering the holder 18 and additionally secured by external fastener 27 as shown in FIGS. 11(*a*) to 11(*d*). The insert 12 before the folding is shown in FIG. 11(*a*); FIG. 11(*b*) demonstrates the insert wrapped around the rim 18 of holder 14 and secured with a fastener 27 such as clamp, ring, zip tie, belt, etc. Alternatively, the fastener 27, can be a belt, buttons, Velcro, hooks, etc., and be made on the end of the insert. FIG. 11(*c*) and FIG. 11(*d*) illustrate such fastener 27 in untightened and tightened states respectively. In yet another example, this fixture allows sizing of the insert length to the height of a holder.
- Insert 12 having a fixture with the extended insert fold 26 forming a yoke for the holder rim 18 as shown in FIG. 12.
- Insert 12 having an outer layer with random or regular spacers 28 and stiffeners as shown in FIG. 13. The spacers and stiffeners 28 can include but are not limited to: pillars or bumps 28*a*, circumferential and vertical struts 28*b*, foam, honeycomb structure 28*c*, any combinations, etc. This can further facilitate enhanced insulation.
- Insert 12 having a fixture with the part or whole length of the insert having accordion fold 29 as shown in FIG. 14. Such fold may provide additional insulation and ability to size the insert length to the height of a holder 14.

In an example, the holder 14 is provided that is lightweight and compactable. The compact and lightweight holder 14 can be fabricated from a recyclable material and thus disposable. Moreover, the holder 14 can be made to be compatible with aforementioned removable and reusable insert 12; and the holder 14 can be also used as a sleeve with a reusable or disposable cup, mug, tumbler, etc.

Referring to FIGS. 15-20, in an example, holder 14 includes a rim 18 and a body 11 and can be made seamless or with one or more seams allowing the holder to be easily folded. The unfolded state of a holder 14 can define a relatively flat two-dimensional shape, including but not limited to: a sector of a ring, rectangle, parallelogram, etc., which can be made from reusable or disposable material with solid filling or having irregular or regular structure, e.g., honeycomb shape, and including but not limited to: paper, corrugated board, metal, plastic, rubber, etc. The holder 14 include opposed connectable ends 31 and 32 that can engage to each other to form a rigid structure operable for receiving an insert 12. The rigid structure forms a body of a drinking vessel but with no bottom which is satisfied by the insert 12 during use.

Figure 15:
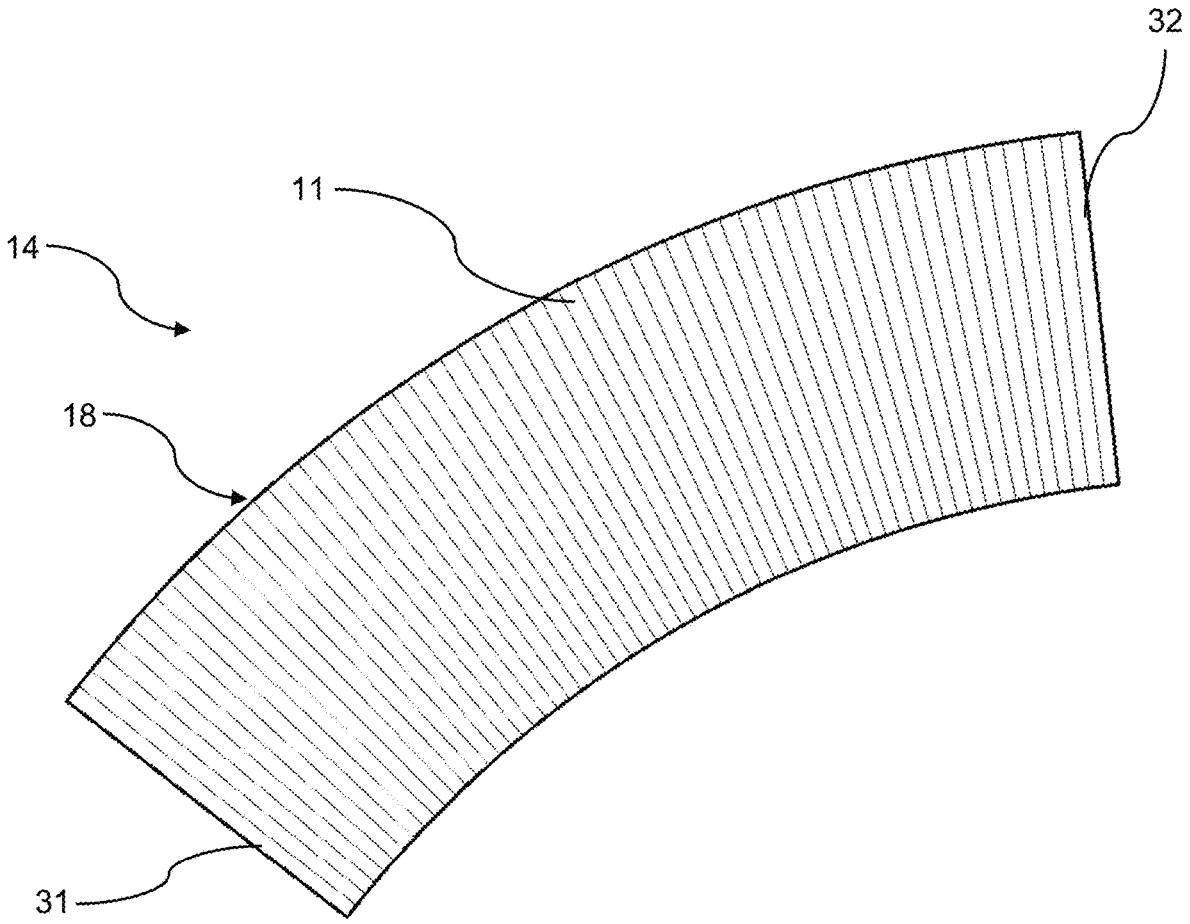
FIG. 15 is an example of unfolded compact and lightweight one seam holder as a sector of a ring.
Figure 16:
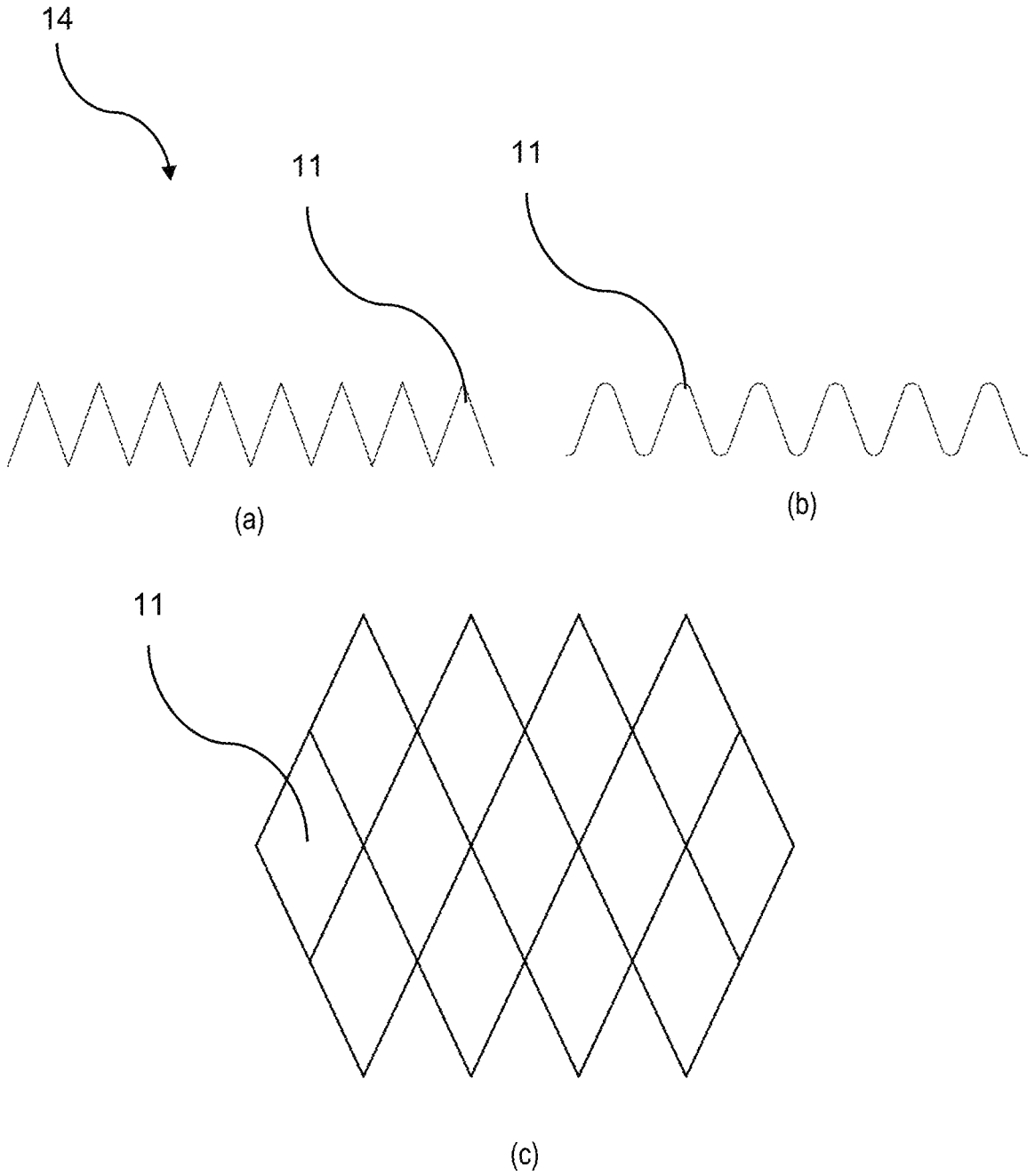
FIG. 16 is an illustration of side view of a fold for the holder: (a) solid filled holder with accordion fold with sharp edges; (b) solid filled holder with accordion fold with smooth edges; (c) example of honeycomb structure.

FIG. 15 shows an example holder 14 in an unfolded state having one seam and shaped as a sector of a ring. The holder 14 can be made of solid filled material and can be folded in irregular or regular pattern with sharp or smooth edges, e.g., corrugated; examples of which are illustrated in FIG. 16(*a*) and FIG. 16(*b*), respectively whereas honeycomb pattern is illustrated in FIG. 16(*c*). It has to be noted that illustrated honeycomb shape is provided as an example, thus, it is not limited to the shape or the width of honeycomb pattern.

Figure 17:
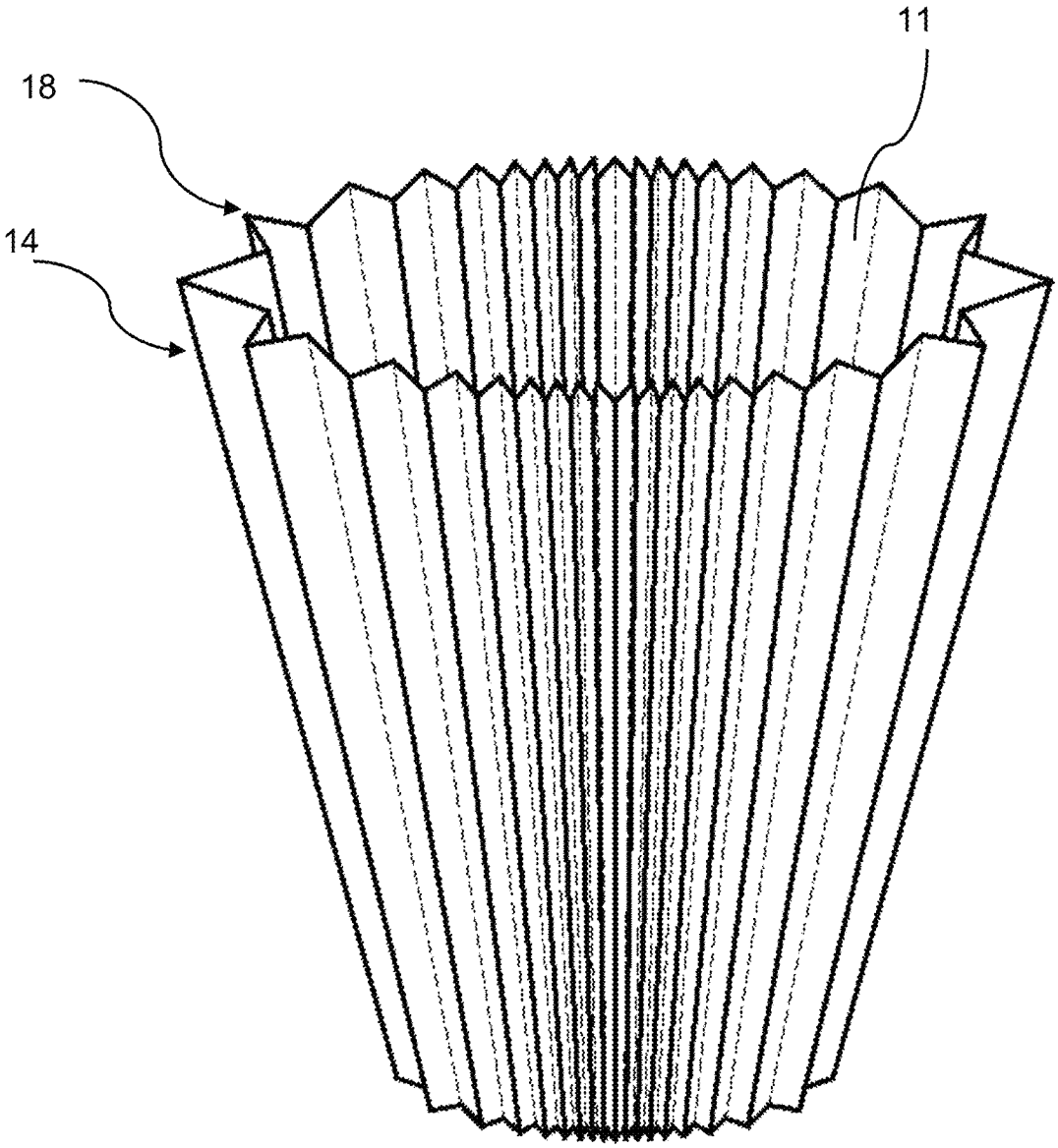
FIG. 17 is an example of assembled compact and lightweight one seam holder, which is similar to the seamless design of the holder, using conical shape accordion fold.
Figure 18:
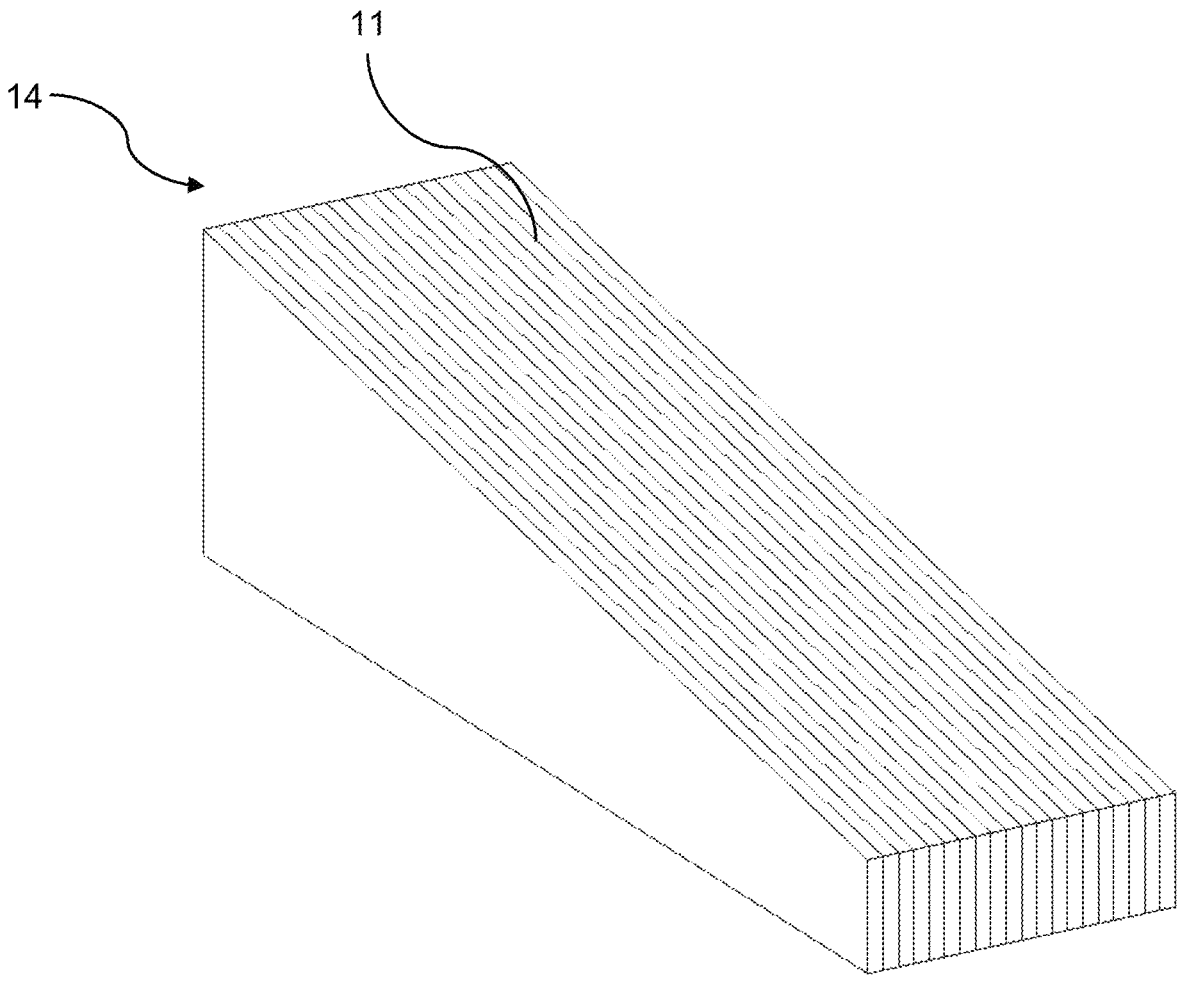
FIG. 18 is an example of folded to compact state compact and lightweight one seam holder.
Figure 19:
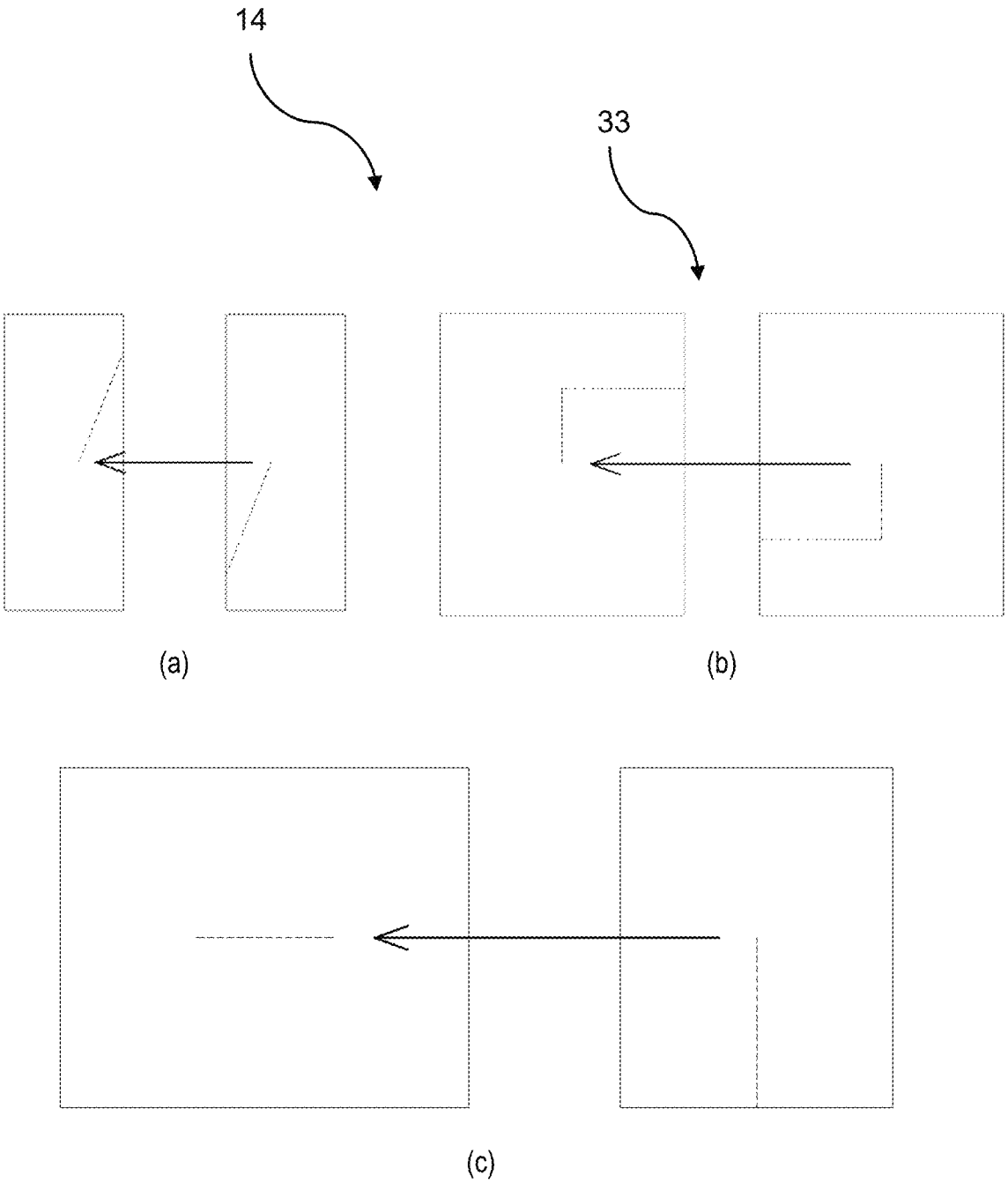
FIG. 19 is an example fixture using cuts (dashed lines) and inserts for the compact and lightweight holder, in an example: (a) diagonal cut; (b) square cut; (c) straight cut.
Figure 20:
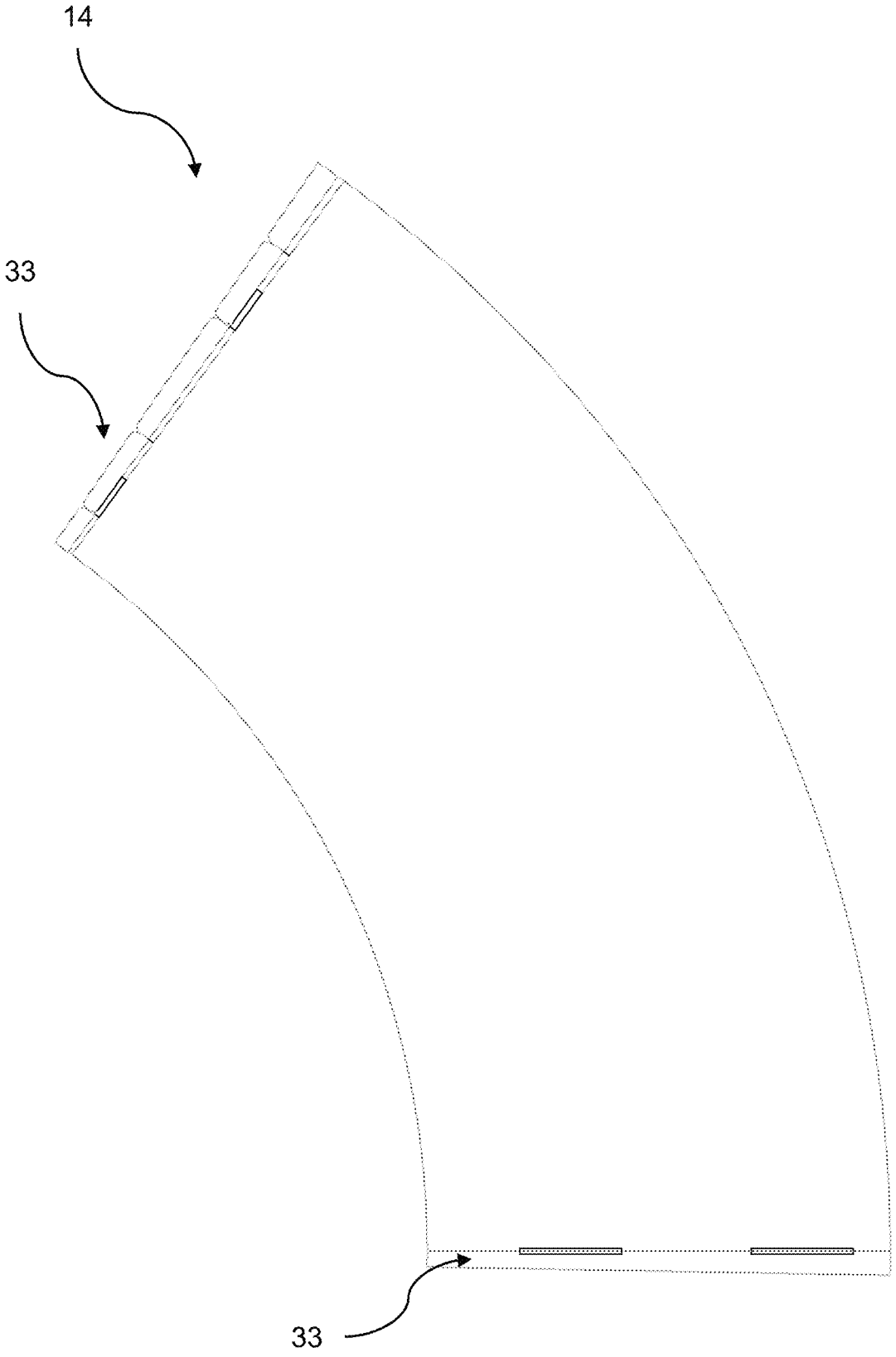
FIG. 20 is an example fixture having hook and locks.

FIG. 17 shows an example holder 14 in an assembled and engaged configuration representing a rigid structure. In an assembled or engaged state where the ends 31 and 32 are connected, the compact and lightweight holder 14 is similar to a seamless design and represents closed surface with one or more openings which include but are not limited to: cone, cylinder, prism, cube, etc. with periodical fold, e.g., accordion or honeycomb type. In folded to compact state, the holder 14 may take the shape of trapezoidal prism as shown in FIG. 18.

The holder 14 of the present disclosure further includes a fastener feature 33 that is formed on ends 31 and 32. This can include, but is not limited to: fasteners, adhesives, buttons, belts, Velcro, cuts and inserts, clamps, and combinations thereof. In yet a further example of FIG. 20, a hook and lock feature is shown to allow for connectability of ends 31 and 32.

The compact and lightweight holder 14 allows for assembly and can form a sleeve if desired for the insert 12. Stiffness of the folded material of the holder 14 can contribute to the rigid structure for engaging with insert 12. In an example, the stiffness of the holder material is selected to sustain a handgrip and act as a lightweight buffer between the insert 12 and a user's hand. Benefits include but are not limited to:

- Enhanced insulation since there may be an air filled buffer zone between the insert or container and user's hand;
- Lightweight, the thickness of the folded material can be smaller compared with other disposable or reusable cups, for example, a sheet of thick paper (0.2 mm) may be sufficient for reliable holder;
- More compact in cases where there is a limitation on the overall size of the holder; and
- Resizable, and can fit inserts or containers with different diameters since the accordion fold or corrugation acts as a spring.

The removable and reusable insert 12 of the present disclosure can be utilized to enhanced insulation and better hygiene to provide better experience to food and beverage consumers. For example, the insert 12 can be used with reusable or disposable containers from restaurants, cafes, coffee shops, vending machines, etc. If the insert 12 is made of flexible and lightweight material, e.g., silicone rubber, it may be compact and highly portable. Moreover, since silicone rubber is hydrophobic, such insert can be cleaned easily, e.g., thorough rinse. These described benefits make the present removable and reusable insert 12 very suitable for multiple uses throughout short time period, e.g., one day.

Another feature of the present disclosure, is to provide eco-friendly solution to reduction of the waste caused by disposable containers, e.g., paper or plastic cups. The renewable resources and clean energy are getting increased attention because of new discoveries in applied science and rapidly growing importance of environment protection. As an example, the amount of solid waste created and valuable resources consumed throughout the process of manufacturing and drinking coffee is an escalating problem. Fifty-eight billion paper cups are thrown away (not recycled) every year; 20 million trees are cut down in the process of manufacturing paper cups; and amount of water used in the process is approximately 12 billion gallons. According to the Environmental Defense Organization, 53000 homes could be powered with the energy consumed through paper cup consumption. Another alarming fact that was discovered is the amount of water used in the process of creating one single cup of latte, which according to the World Wildlife Fund is more than 200 liters (52 gallons). However, paper cups are just part of the problem. The amount of waste resulting from consumer packaging every year is massive. The average person in North America is contributing to the 250 million tons of garbage thrown away every year.

Generally, disposable containers have good thermomechanical properties and are designed with the lifetime far beyond single time usage. However, container contamination compromises its further service with the only options for disposable container to be wasted after first use. To make them waterproof they are usually lined with a membrane of polyethylene (plastic), but it means they are not recyclable alongside paper or cardboard, or biodegradable. Moreover, it was shown that polyethylene (PET, LDPE, HDPE) releases estrogenic chemicals, which can cause health-related problems, such as early puberty in females, reduced sperm counts, altered functions of reproductive organs, obesity, altered sex-specific behaviors, and increased rates of some breast, ovarian, testicular, and prostate cancers.

In order to provide the sustainability many solutions were proposed, such as KARMA CUPS concept and reusable and recyclable cup from STARBUCKS® made from polypropylene. Unfortunately, none of the proposed methods dramatically reduce the waste caused by the paper cups. According to KARMA CUP, the solution is sustainable, but not convenient; only 1.84% customers were using personal tumblers in 2013, which has increased to about 5% in 2015. Polypropylene has below average thermal resistance, e.g., it becomes brittle under 0° C., and it is liable to chain degradation from exposure to heat and UV radiation; also it can be recycled only through some curbside programs. Lastly, polypropylene, as many other plastics, was shown to release estrogenic chemicals, which are hazardous to human health. It has to be mentioned that the removable and reusable insert is intended to be made plastic-free, e.g., from silicone rubber.

When the present removable and reusable insert is placed inside the disposable holder, e.g., container, it prevents the disposable holder from contamination. Hence, the holder, e.g., container, which is used along with the removable and reusable insert does not have to be waterproof, i.e., having plastic coating, and be made from virgin paper. This allows the container to be made from recycled paper and to be recycled or reused after use. The removable and reusable insert is intended to be made from recyclable material, which should reduce the negative impact on the environment.

While this disclosure contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The separation of various device components in the embodiments described in this patent document should not be understood as requiring such separation in all embodiments.

Only a few implementations and examples are described and other implementations, enhancements and variations can be made based on what is described and illustrated in this disclosure.

The foregoing disclosure has been illustrated and described in accordance with the relevant legal standards, it is not intended that these examples illustrate and describe all possible forms of the present disclosure, thus the description is exemplary rather than limiting in nature. Variations and modifications to the disclosed examples may become apparent to those skilled in the art and fall within the scope of the present disclosure. Additionally, the features and various implementing examples may be combined to form further examples of the present disclosure.

What is claimed is:

1. A drinking vessel system comprising:

a reusable holder having a body that is open ended as a rigid sleeve having no bottom, the holder forming a rigid structure having a sidewall, a rim, and defining an opening;

a reusable insert having a flexible body sized and shaped to fit within the opening of the holder and engage and connect to the rigid structure of the holder to be supported structurally by the rigid structure of the holder with an upper portion extending up and over the rim of the reusable holder forming a single drinking vessel unit, the flexible body having a bottom and a sidewall forming a drinking cavity extending from the bottom to the opening;

wherein the reusable insert is entirely formed of a hydrophobic material configured to be foldable as a pocket;

wherein the reusable holder and the reusable insert are disengagable; and wherein the reusable holder and the reusable insert are compactable.

2. The drinking vessel system of claim 1, wherein the flexible body includes at least one insulating layer.

3. The drinking vessel system of claim 1, wherein the flexible body defines an outer surface that traces an inner surface of the holder.

4. The drinking vessel system claim 1, wherein the flexible body includes a plurality of inclusions and reinforcements.

5. The drinking vessel system of claim 4, wherein the plurality of inclusions and reinforcements are dispersed through the flexible body randomly.

6. The drinking vessel system of claim 4, wherein the plurality of inclusions and reinforcements are dispersed through the flexible body according to a predetermined pattern.

7. The drinking vessel system of claim 4, wherein the plurality of inclusions and reinforcements include a member selected from the group consisting of: air, pigments, nanoparticles, nanoclay, microparticles, silica microbubbles, micropolymers, low vacuum voids, ions, chopped fibers, continuous fibers, and combinations thereof.

8. The drinking vessel system of claim 1, further including internal structural reinforcement components included in the flexible body, the components selected from the group consisting of washers, discs, rings, stiffeners, struts, conical cylinders, plates, and combinations thereof.

9. The drinking vessel system of claim 1, further comprising a removal feature extending from the flexible body operable to allow removal from the holder, the removal feature includes a member selected from the group consisting of handles, threads, ribbons, braids, tapes, bands, strips, and combinations thereof.

10. The drinking vessel system of claim 1 wherein the flexible body includes a connection feature operable for securing the insert to the holder, wherein the connection feature is selected from the group consisting of a suction cup, friction force surface, adhesive, clamp, fastener, internal stopper, fixture extending from the insert adapted to fold around a rim of the holder; a flange operable as a stopper; flexible fixture operable to extend around a rim of the holder and at least partially cover the holder and secured by an external fastener, fixture forming a yoke for a rim of the holder; at least one spacer extending from an outer surface of the flexible body, at least one stiffener extending from an outer surface of the flexible body, a pillar, a bump, circumferential strut, vertical strut, foam, a honeycomb structure, accordion fold, and combinations thereof.

11. The drinking vessel system of claim 1, wherein the sidewall of the reusable holder defines a plurality of accordion folds adapted to allow the holder to be compactable.

12. The drinking vessel system of claim 1, wherein the reusable holder is formed between opposed connectable ends, the connectable ends forming the rigid structure when the connectable ends are engaged, and the connectable ends include engaging hook locks.

13. The drinking vessel system of claim 12, wherein the engaging hook locks include a pair of spaced apart lock openings formed on a first end of the connectable ends and a pair of spaced apart mating hooks formed on an opposite second end of the connectable ends, wherein the mating hooks engage the first end of the connectable ends through the corresponding lock openings.

14. The drinking vessel system of claim 1, wherein the reusable holder defines a unitary body absent seams and adapted to form a folding sleeve for receiving the reusable insert.

15. The drinking vessel system of claim 1, wherein the reusable insert forms a rim sized and shaped to receive and engage a standard drinking lid.

16. The drinking vessel system of claim 1, wherein the reusable insert extends around the rim of the reusable holder to form a yoke around the rim of the reusable holder.

17. The drinking vessel system of claim 1, wherein the hydrophobic material is silicon rubber.

* * * * *